US007515726B2

(12) United States Patent
Portmann

(10) Patent No.: US 7,515,726 B2
(45) Date of Patent: Apr. 7, 2009

(54) CONTROL ELEMENT WITH A MECHANICAL ACTUATOR

(75) Inventor: Paul Portmann, Schindellegi (CH)

(73) Assignee: Phonak AG, Stafa (CH)

( * ) Notice: Subject to any disclaimer, the term of this patent is extended or adjusted under 35 U.S.C. 154(b) by 585 days.

(21) Appl. No.: 10/823,213

(22) Filed: Apr. 13, 2004

(65) Prior Publication Data

US 2005/0226448 A1 Oct. 13, 2005

(51) Int. Cl.
*H04R 25/00* (2006.01)

(52) U.S. Cl. ..... 381/324; 381/322; 381/330

(58) Field of Classification Search ..... 381/312, 381/322, 324, 327, 328, 330; 200/11 A, 200/11 R, 52 R
See application file for complete search history.

(56) References Cited

U.S. PATENT DOCUMENTS 5,463,692 A * 10/1995 Fackler ..... 381/324

6,630,639 B2 * 10/2003 McSwiggen ..... 200/52 R

* cited by examiner

*Primary Examiner*—Huyen D Le
(74) *Attorney, Agent, or Firm*—Pearne & Gordon LLP

(57) ABSTRACT

The inventive control element is provided with a mechanical actuator (8) and an electrical or electromechanical switching element (3;4), whereby the switching element (3;4) comprising of at least one push button (5;6) reacting upon pressure. Thereby, the actuator (8) is arranged elastically or resiliently relocatable or tiltable with respect to the switching element (3;4) or the push button (5;6) respectively and an actuating cam (10;11) is further provided at the actuator (8) facing the push button (5;6), whereby the actuator (8) and the switching element (3;4) are not directly connected to each other. The dividing of the control element into two parts, one mechanical actuating part (8) and one electrical switching part (3;4), permits the replacement or exchange only of the mechanical actuating (8) part without any influence to the electrical switching part (3;4). The replacement or exchange therefore may take place without the need of desoldering of the electrical switching part (3;4) from its printed circuit board or from its connected wires.

32 Claims, 3 Drawing Sheets

CONTROL ELEMENT WITH A MECHANICAL ACTUATOR

BACKGROUND OF THE INVENTION

This invention relates to a control element with a mechanical actuator and an electrical or electromechanical switching element, whereby the switching element comprising of at least one push button reacting upon pressure.

The present invention further relates to a hearing device or hearing aid with such a control element with a mechanical actuator and an electrical or electromechanical switching element.

Control elements to be manipulated or controlled by the user of a device from the outside of the device, such as a hearing aid or a hearing device, are commonly provided in form of potentiometers or toggle switches, for instance as volume control. These control elements are provided as complete units, that is the mechanical actuating element accessible from the outside as well as the electrical or electronically switching element are realized in one single piece.

Such control elements are usually soldering attached directly to the printed circuit board of the electronic module of the device or are attached to this printed circuit board by means of electrical conducting wires, which connections are realized as well as soldering connections.

For an economically manufacturing, such control elements have to be mass-produced in standardized specifications. Therefore, such control elements provide of identical electrical switching or control features respectively, but also provide a uniformed shape and color of the mechanical actuating elements.

If an actual control element has to be replaced in a hearing aid or hearing device respectively, the whole or complete control element has to be removed and replaced. For this purpose the hearing aid or hearing device has to be opened and the control element as to be desoldered, which involves a great effort and operating expense. This further causes a great risk of damaging the other electrical and/or electronical components of the hearing device or hearing aid, especially if not performed by especially skilled persons.

This whole work has to be done even if not the electrical component of the control element has to be replaced due to a technical defect but if only the mechanical component, e.g. the mechanical actuator, has to be replaced. This may be the cause not only by technical reasons but also by esthetical reasons.

SUMMARY OF THE INVENTION

It is an object of the present invention to provide an improved control element of which only the mechanical component, e.g. the mechanical actuator, may be easily replaced.

The present invention provides a control element with a mechanical actuator and an electrical or electromechanical switching element, whereby the switching element comprising of at least one push button reacting upon pressure and whereby the actuator is arranged elastically or resiliently relocatable or tiltable with respect to the switching element or the push button respectively and that further an actuating cam is provided at the actuator facing the push button, whereby the actuator and the switching element are not directly connected to each other. The dividing of the control element into two parts, one mechanical actuating part and one electrical switching part, permits the replacement or exchange only of the mechanical actuating part without any influence to the electrical switching part. The replacement or exchange therefore may take place without the need of desoldering of the electrical switching part from its printed circuit board or from its connected wires.

In one embodiment, the switching element comprises of two adjacently arranged, identically built up switching elements connected to each other, each of them comprising one push button. The switching element may thus be built up with known switching technology, for instance with a commonly used micro electrical switching component for reliable and consisting switching functionality.

In another embodiment, the push button comprises of a micro switch, a rubber mat with contacting elements or a twistable punching element. Reliable known electrical switching components may thus be used for the control element.

In a further embodiment, the switching element is arranged on a printed circuit board and may further be soldering connected with conducting paths of the printed circuit board. The switching part of the control element may thus be pre-manufactured whilst fitting the printed circuit board and may further be tested before its assembly into the housing of the hearing device or the hearing aid. Thus, a stable and reliable electrical conducting connection of the electrical or electronical components to be controlled by the control element will be obtained.

In a further embodiment the actuator consists of plastics, with an open resilient profile for a snapping connection with support elements arranged above or laterally of the switching element. The actuator may thus simply be attached and engaged onto the support elements. A simple and easy subsequent replacement of the actuator after its assembly with the device is therefore possible, by unclipping the actuator from its support. The resilient or snapping profile preventing of being unintentionally or independently loosen from the support elements.

In a further embodiment the actuator is having a concave recess towards its operation side. The actuator may thus be easily and secure operated even in miniaturized size, without the need of having visual contact with the actuator.

In another embodiment the actuator is having a tongue protruding to the outside, with concave or convex recessed grip on one or both sides. The tongue provides a leverage effect onto the actuator, and may therefore transform a low force push or pull action into a rocking action of the actuator for activating the push button of the control element.

In a further embodiment the actuator is having both a first contact surface arranged substantially parallel to the push button and a second contact surface arranged substantially perpendicular to the push button and having a rounded shape. A push movement of the actuator may thus for instance be used for the increment of the volume of the hearing device and a pull movement for the decrement of the volume. This may be of an ergonomically advantage, as the pull movement as a rule may be performed quicker and more easily and without the need of visual contact to the actuator then the push movement, and the reduction of a high volume is usually a matter of urgency in contrary to the increasing of the volume.

In a further embodiment, the first contact surface may further comprise of a concave cavity and the second contact surface may have at least partially a cylindrical shape. The concave cavity facilitates the sensing of the actuator without any visual contact to the actuator. The cylindrical shape facilitates a pulling action with the inside of a finger, as well without the need of having visual contact with the actuator.

In a further embodiment the actuator is having a tilting axis, which is formed by a pin arranged above the push button, and whereby the actuator is detachably attached to the tilting axis.

A reliable and break-safe supporting of the actuator may thus be provided, which is easy and cost efficient.

In a further embodiment the actuator is provided of a flexible cover putted over the actuator. The flexible cover may consist of rubber or rubber like material. On one hand, the grip of the actuator is increased, and on the other hand, the control element is protected against environmental influences such as wetness, humidity, sweet and dust. This cover may be provided directly onto the housing by use of multi-component technique, thus providing a seamless sealing of the opening of the actuator in the housing of the device.

The present invention further provides a hearing device or hearing aid with a control element with a mechanical actuator and an electrical or electromechanical switching element, whereby the switching element comprising of at least one push button reacting upon pressure and whereby the actuator is arranged elastically or resiliently relocatable or tiltable with respect to the switching element or the push button respectively and that further an actuating cam is provided at the actuator facing the push button, whereby the actuator and the switching element are not directly connected to each other for the controlling of features of the hearing device or hearing aid respectively. By the combination of two electrical switching elements pure switching actions may be performed as well as control actions of the electronical modules of the hearing device or hearing aid. A short push movement onto a push button may initiate an impulse, whereas a long push movement onto a push button may initiate a pulse string or a continuous signal, which may be analyzed within the electronic unit of the device.

In one embodiment the controlled features comprise a volume control and/or a switching of different program modes. Such a control element is adapted to control the volume of such hearing devices or hearing aids, such as behind-the-ear hearing aids, and may be manipulated easily and reliable even by motor limited persons.

In a further embodiment the switching element is connected directly with a printed circuit board of an electronic module of the device at the inside of the housing, whereby the actuator is protruding at least partially to the outside from an opening of the housing of the device. The switching element may thus already be pre-manufactured together with the printed circuit board and standardized elements may be used. An actuator adapted to the shape of the housing individually manufactured or adapted to the specific needs of a specific user of the device may subsequently be inserted into the device.

In a further embodiment a support for the actuator is arranged within the housing of the device in form of a tilting axis. Thus preventing any force acting onto the actuator by the user to be carried directly onto the switching element and therefore onto the printed circuit board.

Other embodiments of the control element have already been described above and may be uses as well in hearing devices or hearing aids.

The control elements of hearing devices or hearing aids according the present invention may be easily and cost efficient adapted to individual needs with identical functionality. Thus an adaptation of the visible part of the actuator to optically or ergonomically aspects for new hearing devices is possible as well as a replacement of the actuator for existing hearing devices, i.e. for a alternative user handling or alternative shape or color.

DESCRIPTION OF THE DRAWINGS

For purpose of facilitating and understanding of the invention, there is illustrated in the accompanying drawings of embodiments thereof to be considered in connection with the following description. Thus the invention may be readily understood and appreciated.

DESCRIPTION OF SOME EMBODIMENTS

Figure 1:
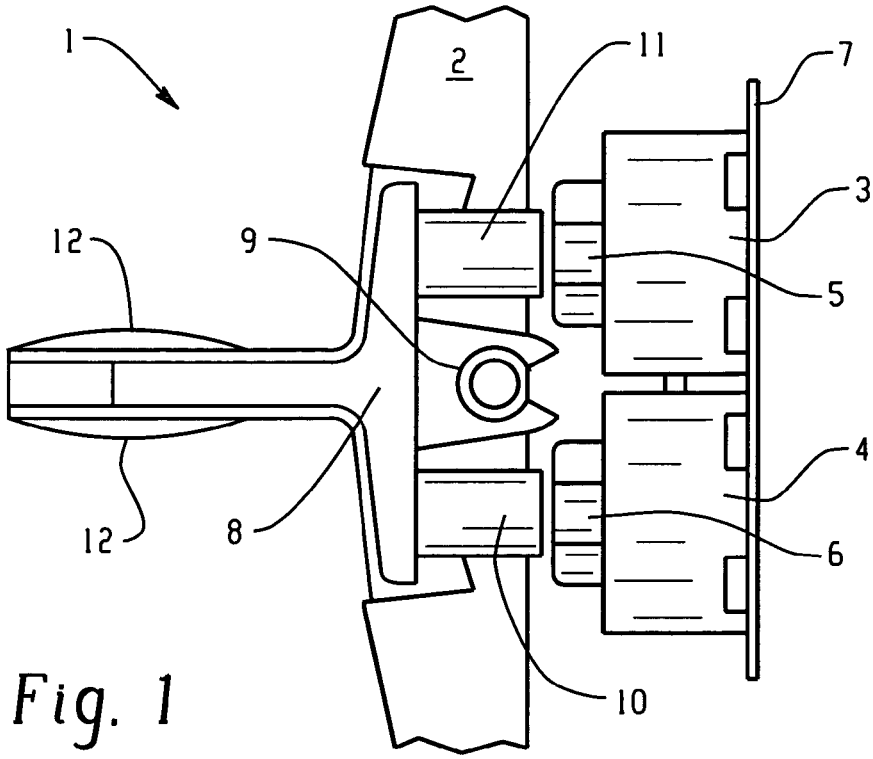
FIG. 1 is a schematical side view of an inventive control element assembled within a hearing aid.

Referring to FIG. 1, the schematical cross sectional view of an inventive control element 1 is shown installed within a hearing aid 2. The control element comprises of two adjacently arranged switching elements 3 and 4 attached to each other.

The switching elements 3 and 4 respectively have a common layout and have push buttons protruding to the outside. The switching elements 3 and 4 respectively may be micro switches or switch components with a rubber mat as push button 5 and 6 respectively. The switching elements 3 and 4 may as well comprise of electrical conductive, twistable punching elements. The switching elements 3 and 4 are electrical electroconductive connected with the printed circuit board 7. They may be directly connected to the printed circuit board 7 by soldering and thus as well establishing a mechanical connection.

The mechanical actuator 8 is arranged above both of the switching elements 3 and 4, e.g. in form of a rocker with a tongue protruding to the outside, as shown in FIG. 1. The actuator 8 is tiltable around its axis 9 in both directions, whereby neither the axis 9 nor the actuator 8 is directly connected with the switching elements 3 or 4. Known resilient elements or stop elements may further be provided to set the actuator 8 in its rest position or to postpone the actuator 8 to its rest position.

The actuator 8 has actuating cams 10 and 11 directed to the push buttons 5 and 6, which may contact and actuate the push buttons 5 or 6 respectively by tilting the actuator 8 around its axis 9 and thereby initiate the switching operation.

The tongue of actuator 8 shown in FIG. 1 has a convex recessed grip 12 on both sides of its surface. The surface of those recessed grips 12 may be provided with additional ribs or a rough structure for a better grip or may be coated with a grip coating.

The tongue may easily and safe be handled with the inner side of a finger whereby only a light push or pull action has to be performed for the switching action.

Figure 2:
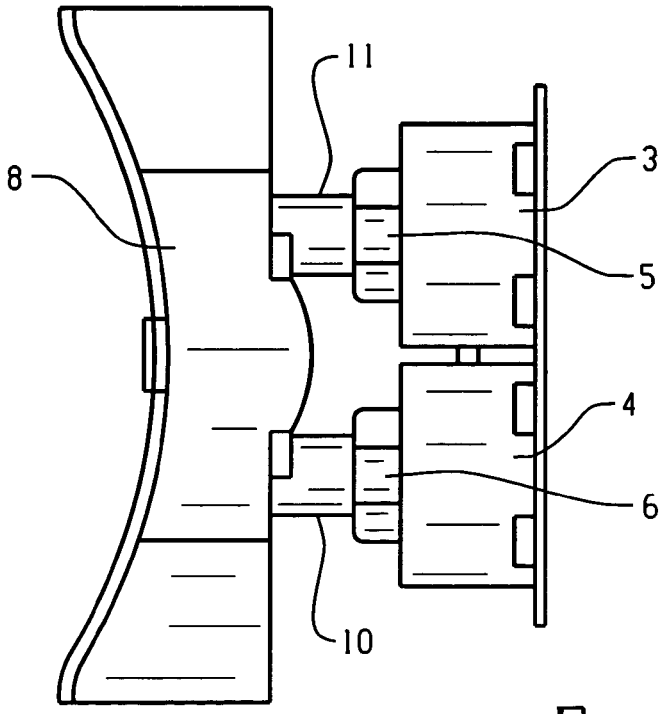
FIG. 2 is a schematical side view of an alternative inventive control element.

An alternative embodiment of the actuator 8 of an inventive control element 1 is shown in FIG. 2. The switching elements 3 and 4 are identical with respect to FIG. 1. The actuator 8 is provided as a simple rocker with concave rounded surface towards its operation outwardly face. The actuator 8 does not have a defined or physical axis but is guided movable within the housing of the hearing device 2. The rest position of the actuator 8 shown in FIG. 2 may be assured by means of spring elements (not shown in FIG. 2). The upper or lower switching element 3 or 4 respectively will be activated by pressing or pushing onto the upper or lower part of the actuator 8. A By pressing onto the middle part of the actuator 8 both switching elements 3 and 4 may be jointly activated and thus a joint switching action may be initiated.

Figure 3:
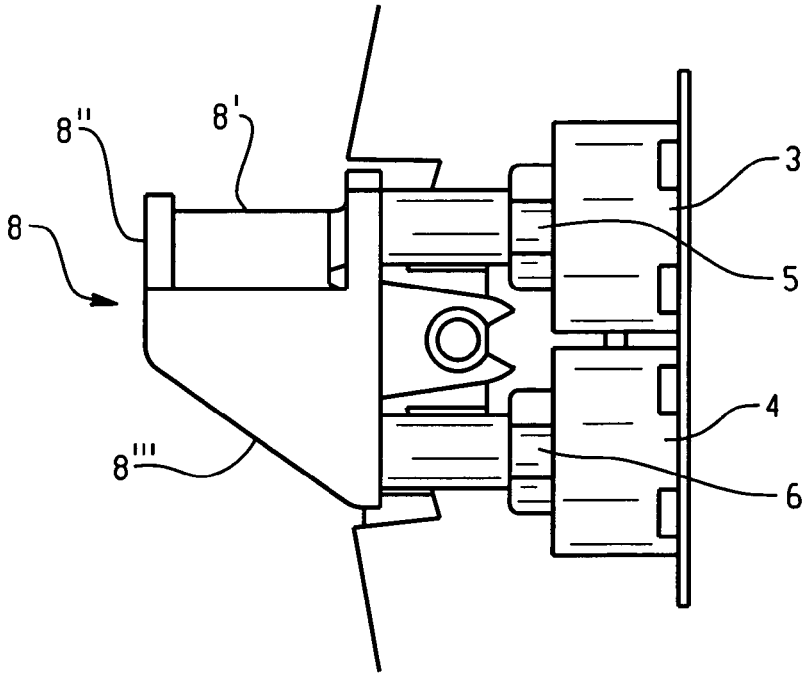
FIG. 3 is a schematical side view of another alternative inventive control element.

A further alternative embodiment of the actuator 8 is shown in FIG. 3. The actuator 8 is provided in form of a rocker with a fixed tilting axis 9 analogue to the embodiment of FIG. 1. A protruding body with partly cylindrical shape is provided instead of the tongue of FIG. 1. The upside rim 8' has the shape of a half-cylinder and is easy and reliable tangible with the inner side of a finger, and by pulling this rim 8' with the finger a switching action of the lower switching element 4 will be initiated. By pressing onto the face part 8" or onto the tilted ramp part 8''' of the actuator 8 a switching action will be initiated by the upper switching element 3. The different functions of the hearing aid associated to those different actuating actions will thus easy be learned and memorized by the user of the hearing aid and may be reproduced with a lower error ratio.

Figure 4:
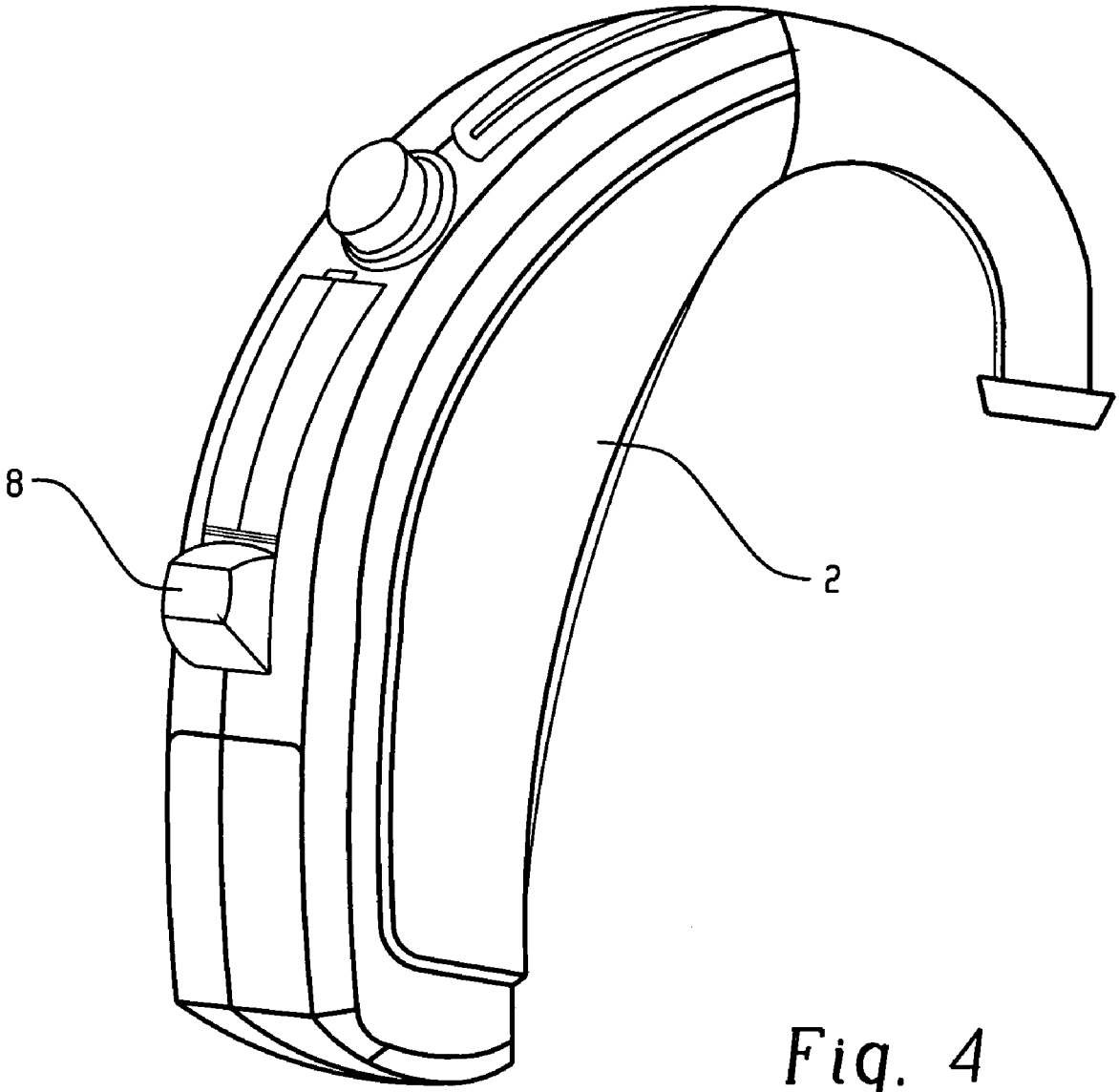
FIG. 4 is a view of a hearing aid with the control element according to FIG. 3.

The view of a behind-the-ear hearing aid with an inventive control element according FIG. 3 is shown in FIG. 4.

Figure 5:
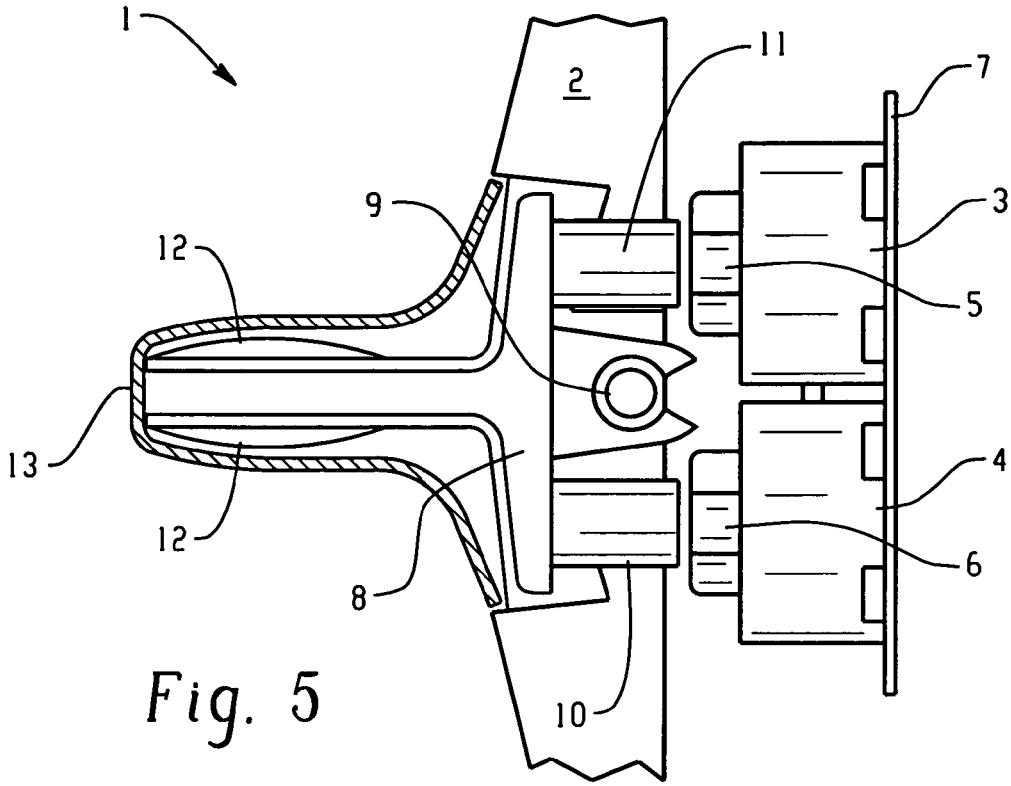
FIG. 5 is a schematical sectional view of the control element according FIG. 1 with a flexible cover.

The embodiment of the control element according FIG. 1 with a cover 13 putted over the actuator 8 is shown in FIG. 5, thereby sealing the opening for the actuator 8 in the housing of the hearing aid 2. This cover 13 prevents any dirt or humidity from penetrating into the housing of the hearing aid 2.

One advantage of the inventive control element lies in the fact that the actuator 8 may be assembled or replaced without the need of opening the housing of the hearing aid 2. The switching elements 3 and 4 are not affected by such assembly or replacement activities and may be left onto the printed circuit board 7 untouched. Thus, standardized elements in identical shape and function may be used as switching elements 3 or 4 respectively with positive influence onto the production costs, and however individually shaped or adapted actuators 8 may be used. Such customized adapters 8 may be economically produced even in small numbers.

I claim:

1. Control element with a mechanical actuator (8) and an electrical or electromechanical element (3;4), whereby the switching element (3;4) comprising of at least one push button (5;6) reacting upon pressure and whereby the actuator (8) is arranged elastically or resiliently relocatable or tiltable with respect to the switching element (3;4) or the push button (5;6) respectively and that further an actuating cam (10;11) is provided at the actuator (8) facing the push button (5;6), whereby the actuator (8) and the switching element (3;4) are separately mounted parts and the actuator (8) and the switching element (3;4) are not directly connected to each other.

2. Control element according claim 1, whereby the switching element is comprising of two adjacently arranged, identically built up switching elements (3,4) connected to each other, each of them comprising one push button (5,6).

3. Control element according claim 1 with the push button (5;6) comprising of a micro switch, a rubber mat with contacting elements or a twistable punching element.

4. Control element according claim 1 whereby the switching element (3;4) is arranged on a printed circuit board (7).

5. Control element according claim 4 whereby the switching element (3;4) is soldering connected with conducting paths of the printed circuit board (7).

6. Control element according claim 1 with the actuator (8) consisting of plastics, with an open resilient profile for a snapping connection with support elements (9) arranged above or laterally of the switching element (3;4).

7. Control element according claim 1 with the actuator (8) having a concave recess towards its operation side.

8. Control element according claim 1 with the actuator (8) having a tongue protruding to the outside, with concave or convex recessed grip (12) on one or both sides.

9. Control element according claim 1 with the actuator (8) having both a first contact surface (8") arranged substantially parallel to the push button (5;6) and a second contact surface (8') arranged substantially perpendicular to the push button (5;6) and having a rounded shape.

10. Control element according claim 9 with the first contact surface (8") comprising of a concave cavity and the second contact surface (8') having at least partially a cylindrical shape.

11. Control element according claim 1 whereby the actuator (8) having a tilting axis (9), which is formed by a pin arranged above the push button (5;6), and whereby the actuator (8) is detachably attached to the tilting axis (9).

12. Control element according claim 1 whereby the actuator (8) is provided of a flexible cover (13) putted over the actuator (8).

13. Control element according claim 12 whereby the flexible cover (13) consists of rubber or rubber like material.

14. Control element according to claim 1, whereby the actuator (8) is mounted to a housing (2) and the switching element (3;4) is mounted to a printed circuit board (7).

15. Control element with a mechanical actuator (8) and an electrical or electromechanical switching element (3;4), whereby the switching element (3;4) comprising of at least one push button (5;6) reacting upon pressure and whereby the actuator (8) is arranged elastically or resiliently relocatable or tiltable with respect to the switching element (3;4) or the push button (5;6) respectively and that further an actuating cam (10; 11) is provided at the actuator (8) facing the push button (5;6), whereby the actuator (8) and the switching element (3;4) are separately mounted parts such that the actuator (8) can be replaced without affecting the switching element (3;4) which is left installed in the control element.

16. Hearing device or hearing aid with a control element with a mechanical actuator (8) and an electrical or electromechanical switching element (3;4) for the controlling of features of the hearing device or hearing aid respectively, whereby the switching element (3;4) comprising of at least one push button (5;6) reacting upon pressure and whereby the actuator (8) is arranged elastically or resiliently relocatable or tiltable with respect to the switching element (3;4) or the push button (5;6) respectively and that further an actuating cam (10;11) is provided at the actuator (8) facing the push button (5;6); whereby the actuator (8) and switching element (3;4) are separately mounted parts whereby the actuator (8) is mounted directly to a housing (2) of the hearing device or hearing aid and the switching element (3;4) is mounted on a structure distinct from the housing (2); wherein the actuator (8) can be replaced without Removing any structure touching the switching element (3;4).

17. Hearing device or hearing aid according claim 16 whereby the controlled features comprise a volume control and/or a switching of different program modes.

18. Hearing device or hearing aid according claim 16 whereby the switching element (3;4) is connected directly with a printed circuit board (7) of an electronic module of the device at the inside of the housing (2), whereby the actuator (8) is protruding at least partially to the outside from an opening of the housing (2) of the device (1).

19. Hearing device or hearing aid according claim 16 with a support for the actuator (8) arranged within the housing (2) of the device in form of a tilting axis (9).

20. Hearing device or hearing aid according claim 16, whereby the switching element is comprising of two adjacently arranged, identically built up switching elements (3,4) connected to each other, each of them comprising one push button (5,6).

21. Hearing device or hearing aid according claim 16 with the push button (5;6) comprising of a micro switch, a rubber mat with contacting elements or a twistable punching element.

22. Hearing device or hearing aid according claim 16 whereby the switching element (3;4) is arranged on a printed circuit board (7).

23. Hearing device or hearing aid according claim 22 whereby the switching element (3;4) is soldering connected with conducting paths of the printed circuit board (7).

24. Hearing device or hearing aid according claim 16 with the actuator (8) consisting of plastics, with an open resilient profile for a snapping connection with support elements (9) arranged above or laterally of the switching element (3;4).

25. Hearing device or hearing aid according claim 16 with the actuator (8) having a concave recess towards its operation side.

26. Hearing device or hearing aid according claim 16 with the actuator (8) having a tongue protruding to the outside, with concave or convex recessed grip (12) on one or both sides.

27. Hearing device or hearing aid according claim 16 with the actuator (8) having both a first contact surface (8") arranged substantially parallel to the push button (5;6) and a second contact surface (8') arranged substantially perpendicular to the push button (5;6) and having a rounded shape.

28. Hearing device or hearing aid according claim 16 with the first contact surface (8") comprising of a concave cavity and the second contact surface (8') having at least partially a cylindrical shape.

29. Hearing device or hearing aid according claim 16 whereby the actuator (8) having a tilting axis (9), which is formed by a pin arranged above the push button (5;6), and whereby the actuator (8) is detachably attached to the tilting axis (9).

30. Hearing device or hearing aid according claim 16 whereby the actuator (8) is provided of a flexible cover (13) putted over the actuator (8).

31. Hearing device or hearing aid according claim 30 whereby the flexible cover (13) consists of rubber or rubber like material.

32. Control element according to claim 16, whereby the actuator (8) is mounted to a housing (2) and the switching element (3;4) is mounted to a printed circuit board (7).

* * * * *

UNITED STATES PATENT AND TRADEMARK OFFICE

CERTIFICATE OF CORRECTION

PATENT NO. : 7,515,726 B2
APPLICATION NO. : 10/823213
DATED : April 7, 2009
INVENTOR(S) : Paul Portmann It is certified that error appears in the above-identified patent and that said Letters Patent is hereby corrected as shown below:

In the claims, column 5, line 44, please add the word -- switching -- between the words "electromechanical" and "element".

In the claims, column 6, line 57, the word "Removing" should be all lowercase letters and should appear as -- removing --.

Signed and Sealed this

Eleventh Day of August, 2009

David J. Kappos

David J. Kappos
*Director of the United States Patent and Trademark Office*